US005423657A

United States Patent [19]

Frost et al.

[11] Patent Number: 5,423,657

[45] **Date of Patent: * Jun. 13, 1995**

[54] PREFEEDER FOR STACKED SHEETS OF PAPERBOARD PRODUCTS

[75] Inventors: Terry M. Frost, Spokane, Wash.; Terry B. Smith, Coeur d'Alene, Id.; Jon P. Drake, Chattearoy; Hugh F. Moran, Spokane, both of Wash.

[73] Assignee: ASC Machine Tools, Inc., Spokane, Wash.

[ * ] Notice: The portion of the term of this patent subsequent to Apr. 27, 2010 has been disclaimed.

[21] Appl. No.: 51,740

[22] Filed: Apr. 22, 1993

Related U.S. Application Data

[63] Continuation of Ser. No. 572,144, Aug. 20, 1990, Pat. No. 5,205,704.

[51] Int. Cl.[6] ..... B65H 3/24; B65H 5/36

[52] U.S. Cl. ..... 414/796.8; 198/861.3; 271/280; 414/796; 414/796.4

[58] Field of Search ..... 198/861.3, 861.5, 861.1; 271/34, 35, 151, 182, 198, 216, 221, 229, 237, 238, 241, 280, 303; 414/765, 786, 796, 796.4, 796.8

[56] References Cited

U.S. PATENT DOCUMENTS 2,940,617 6/1960 Reed .
3,581,912 6/1971 Bennett .
3,805,982 4/1974 Tolf et al. .
3,815,762 6/1974 Hoke et al. .
4,265,578 5/1981 Frederick et al. .
4,457,658 7/1984 Meylan .
4,619,571 10/1986 Peiffer .
4,700,941 10/1987 Shill ..... 271/151
4,715,488 12/1987 Hewitt et al. ..... 193/35 R
5,028,201 7/1991 Hawthorne ..... 414/796.8 X

FOREIGN PATENT DOCUMENTS 2313294 12/1976 France .
108365 8/1979 Japan .
176776 7/1989 Japan .

*Primary Examiner*—Michael S. Huppert
*Assistant Examiner*—Janice L. Krizek
*Attorney, Agent, or Firm*—Bill D. McCarthy

[57] ABSTRACT

An improved prefeeder assembly for shingling planar sheets in which a sheet stack is positioned on a prefeeder lift conveyor which lowers the sheet stack into a floor pit to incrementally elevate the sheet stack. A block pusher assembly sequentially pushes bock segments to a conveyor assembly where a shingling assembly shingles the sheets. A bottom sheet removal assembly having an in-path diverter plate contacts and diverts only the bottom sheet of the bottommost block segment as this block segment is being shingled. As shingled sheets are discharged to other process equipment, a tamping assembly tamps the sheet edges for uniform restacking.

7 Claims, 9 Drawing Sheets

PREFEEDER FOR STACKED SHEETS OF PAPERBOARD PRODUCTS

RELATED APPLICATION

This application is a continuation of U.S. patent application Ser. No. 07/572,144, filed Aug. 20, 1990 entitled APPARATUS FOR PREFEEDING SHEETS OF PAPERBOARD PRODUCTS, now U.S. Pat. No. 5,205,704, the details of which are incorporated herein by reference.

BACKGROUND OF THE INVENTION

1. Field of the Invention

The present invention relates generally to the field of material handling equipment, and more particularly, but not by way of limitation, to an improved method and apparatus for prefeeding stacked paperboard products at high speeds wherein such products are shingled prior to further processing.

2. Discussion

The packaging of products in paperboard containers or boxes has increased so much over the years that a very large packaging industry has emerged. It is common to cut paperboard container blanks from planar sheets of corrugated composition. Excess trim is removed from the blanks and the blanks are stacked flat in bundles for movement to points of usage.

The work function which is addressed by the present invention is that of prefeeding the flats or blanks in stacks of sheets, shingling the sheets and passing same to other processes within a paperboard products plant. Further, it is often desired that the bottommost sheet of a stack be removed because this bottom sheet serves as a dunnage sheet, becoming marred by the travel of the stack on roller conveyors that move such stacks in a paperboard products plant. This is exacerbated by the fact that the height of such stacks can reach as high as 8 feet or more, and with the weight of multiple layered corrugated composition, the stacks can weigh a thousand pounds or more.

Further, for some applications, it is desirable that the blanks or sheets be inverted prior to feeding same to some unit operations in the paperboard products plant. An example is where sheets, having been printed on one side, require inverting prior to being passed to another printing operation. Accordingly, one of the work functions addressed herein is that of providing an inline invertor assembly for inverting the sheets.

One difficulty with prior art prefeeders of the type under consideration herein is that such prior art prefeeders have required considerable height in order to accommodate very tall stacks of paperboard container blanks. It would be very useful if the work functions addressed by the present invention could be carried out with machinery that is readily accessible by operating personnel at floor level.

None of the prior art prefeeders known to the present inventors achieve these desired improvements. It is to that end to which the present invention is directed.

SUMMARY OF THE INVENTION

The present invention provides an improved prefeeder assembly for processing a stack of paperboard products (such as cardboard sheets or similar planar materials, hereinafter referred to for convenience of description as a sheet stack) requiring shingling and restacking for feeding to another paper treating process, such as multiple bin fed printing operation. In the preferred embodiment, an infeed lift conveyor assembly receives the sheet stack at floor level and lowers the sheet stack into a pit to dispose a portion of the sheets below floor level. The infeed lift conveyor assembly incrementally lifts the sheet stack to expose block segments of the sheets at a predetermined height for removal therefrom.

A block pusher assembly is first pivotally raised to an elevated position to provide clearance as the sheet stack is moved onto the infeed lift conveyor assembly, and the block pusher is then pivotally lowered to begin sequentially pushing block segments from the sheet stack onto a conveyor assembly.

A shingling assembly is disposed in the travel path of the conveyor assembly to shingle the sheets on the conveyor assembly prior to discharge into a sheet feeder hopper or the like for other processing equipment.

In one aspect of the invention, the bottommost sheet in the stack must be removed. The bottommost block segment on the infeed lift conveyor assembly is the last block segment pushed onto the conveyor assembly by the block pusher assembly, and a bottom sheet removal assembly effects the removal of the bottom sheet of this last block segment.

As the shingled sheets are discharged from the conveyor assembly, a tamper assembly causes the edges of the sheets to be effectually tamped so that the discharging, shingled sheets are aligned in an even edged stack as the sheets fall into the sheet feeder hopper.

In another aspect of the invention, it is desirable to invert the sheets. To this end an invertor assembly is disposed along the travel path to invert the entire block segments prior to shingling same. In this embodiment, the bottom sheet removal assembly is usually not required, but can be used if so desired.

An object of the present invention is to provide an improved prefeeder assembly capable of high speed shingling of sheets of paperboard products substantially at operator reachable heights from floor level.

Another object of the present invention, while achieving the above stated object, is to provide a prefeeder assembly capable of receiving and shingling very tall stacks of paperboard products substantially at operator reachable heights at floor level.

One other object of the present invention is to provide a prefeeder assembly which achieves the above stated object while also providing for the automatic removal of the bottom sheet of the sheet stack as the bottommost block segment is processed.

Yet another object of the present invention, while achieving the above stated objects, is to provide a prefeeder assembly which can invert the block segments as such are processed.

Another object of the present invention is to provide a prefeeder assembly which achieves the above stated objects at a minimum capital investment cost; which can be operated with a minimum of operator attention; and which requires a minimum of maintenance.

Other objects, advantages and features of the present invention will become clear from the following description of the preferred embodiment when read in conjunction with the accompanying drawings and appended claims.

BRIEF DESCRIPTION OF THE DRAWINGS

FIG. 6 is a side elevational, semi-diagrammatical depiction of the shingling assembly of the prefeeder assembly of FIG. 1.

FIG. 8 is a bottom plan, partial detailed view of one pair of the balloon cylinders and one of the tamper plates of the tamper assembly of the prefeeder assembly of FIG. 1.

FIG. 9 is a pneumatic schematic for the tamper assembly.

DESCRIPTION

Like numerals and characters designate like elements throughout the figures of the drawings.

Figure 1:
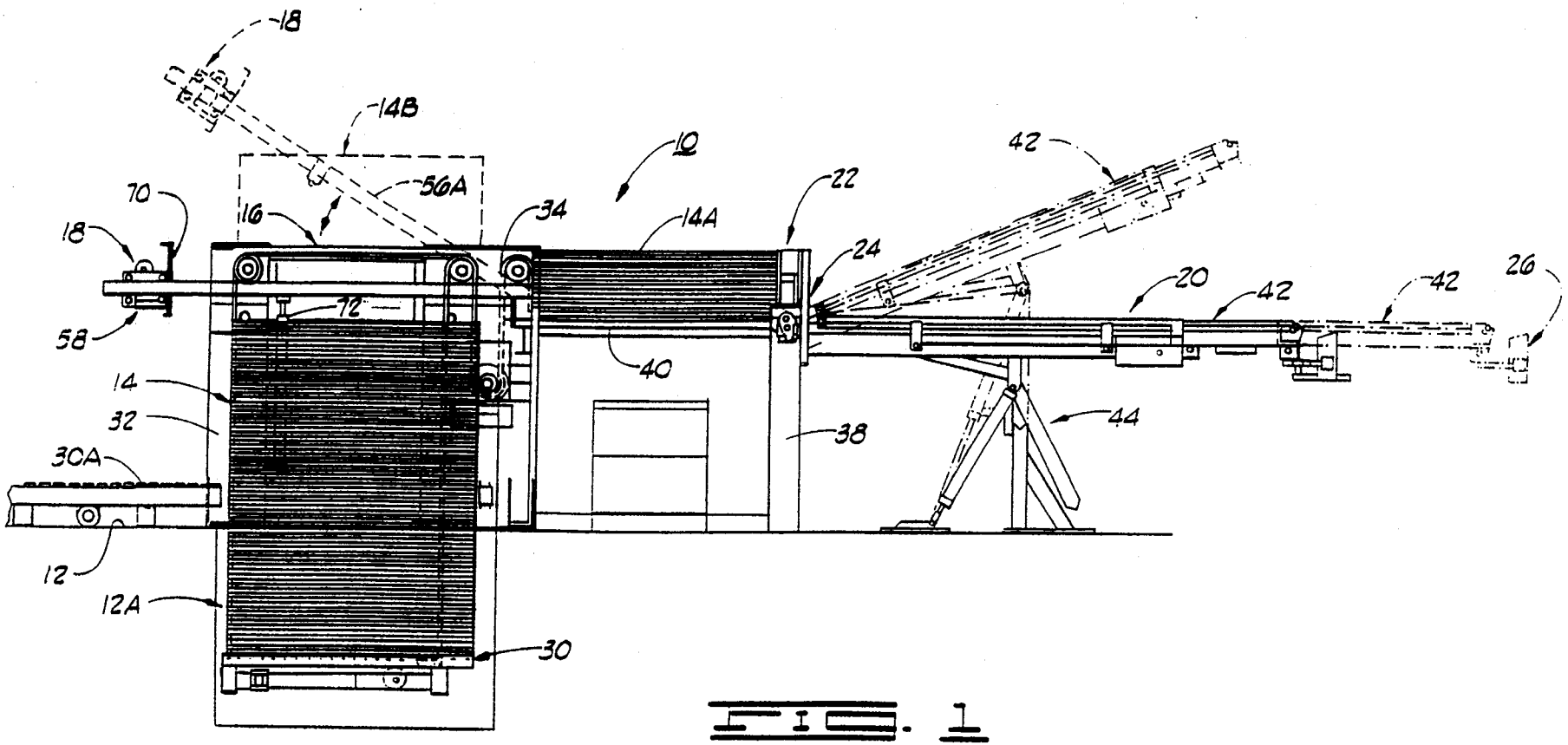
FIG. 1 is a side elevational view in semi-detail of a prefeeder assembly constructed in accordance with the present invention.

Reference is initially directed to FIG. 1 which shows a side elevational, semi-detailed view of a prefeeder assembly constructed in accordance with the present invention. Other views of the various stations may prove helpful and are provided for convenience. More specifically:

10 depicts the prefeeder assembly.

12 is the support floor upon which the prefeeder assembly 10 is supported. 12A is a pit in the support floor 12.

14 depicts a sheet stack, or that is, a relatively tall stack of paperboard products such as cardboard sheets. 14A is a block segment of sheets removed from the sheet stack 14. The dimensions of the sheet stack 14 will vary in actual practice and, in the accompanying drawings, are depicted in maximum size.

Figure 2:
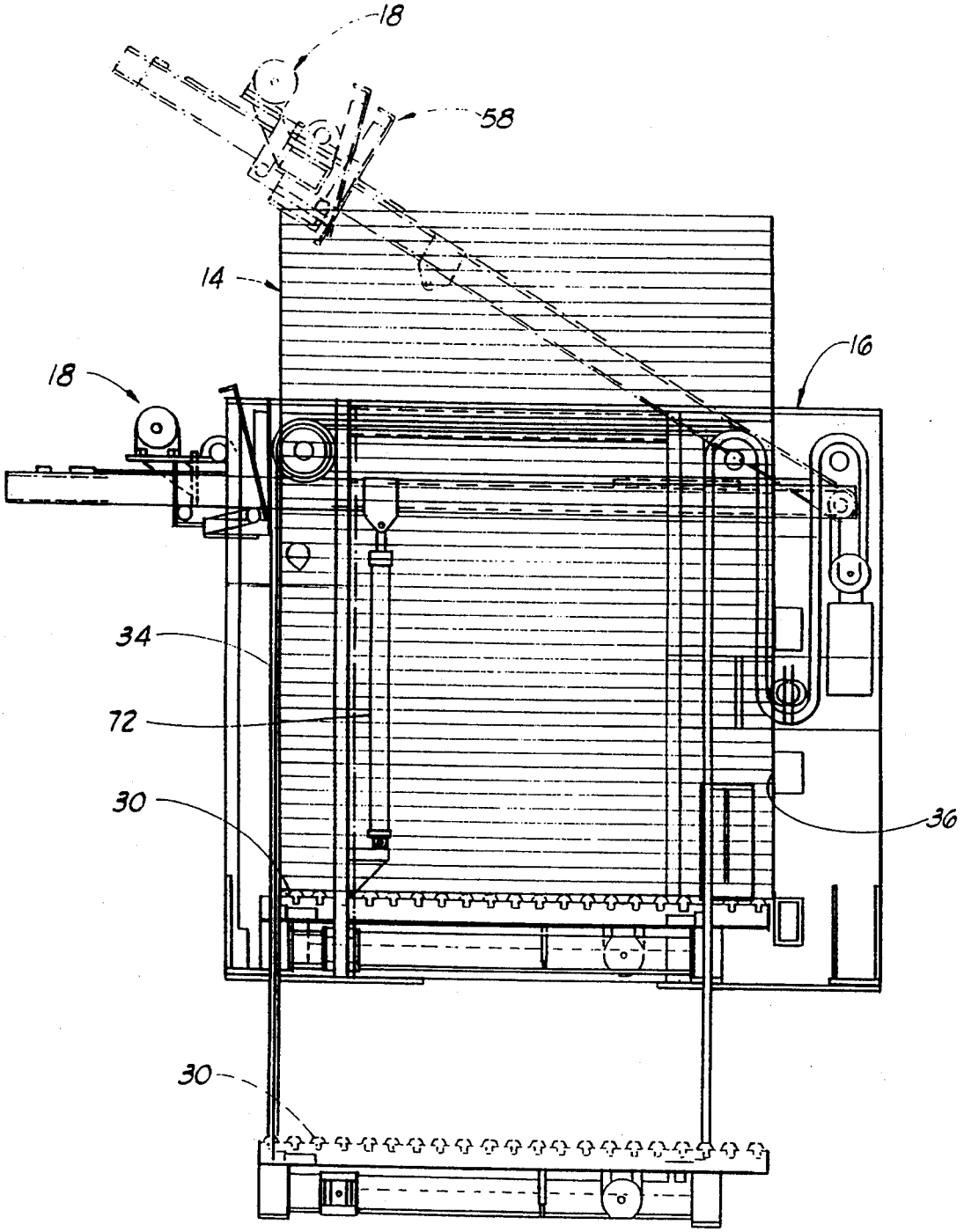
FIG. 2 is a semi-detailed, enlarged side elevational view of the prefeeder lift conveyor assembly and block pusher assembly of the prefeeder assembly of FIG. 1.

16 is an infeed lift conveyor assembly which is shown in more detail in FIG. 2.

Figure 5A:
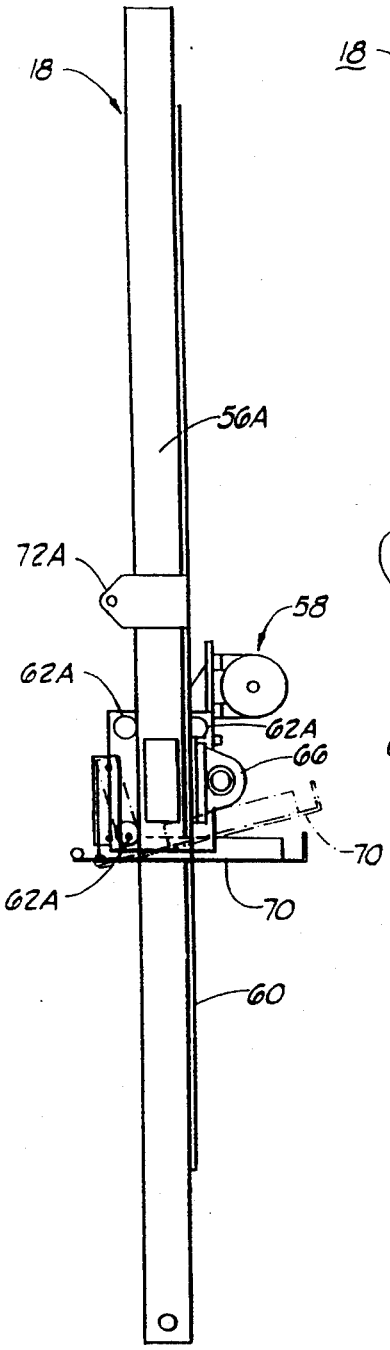
FIGS. 5A and 5B are side and end elevational views thereof, respectively.

18 is a block pusher assembly which will be described hereinbelow with reference more specifically to FIGS. 5 through 5C.

Figure 3:
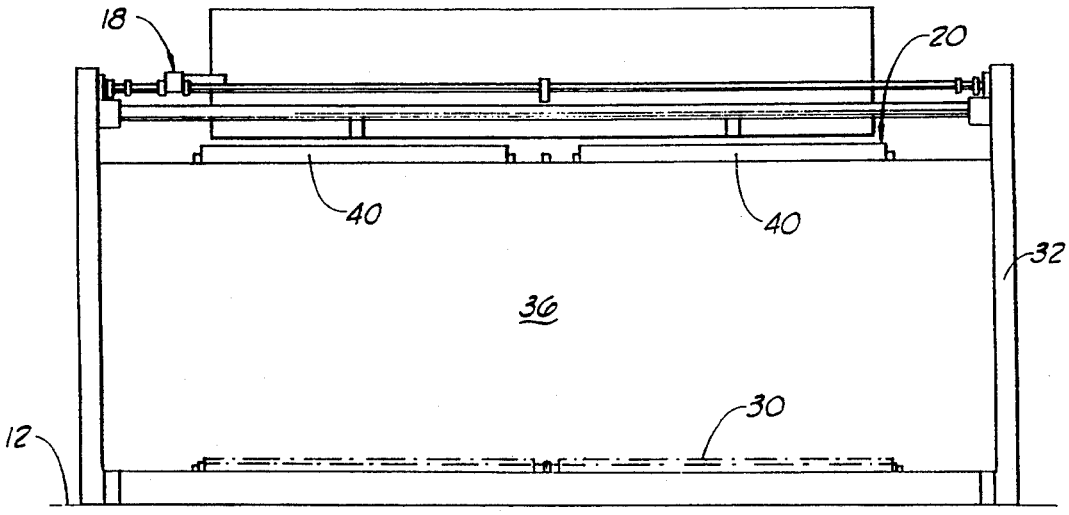
FIG. 3 is a partially detailed, and elevational view of the infeed lift conveyor assembly.
Figure 4:
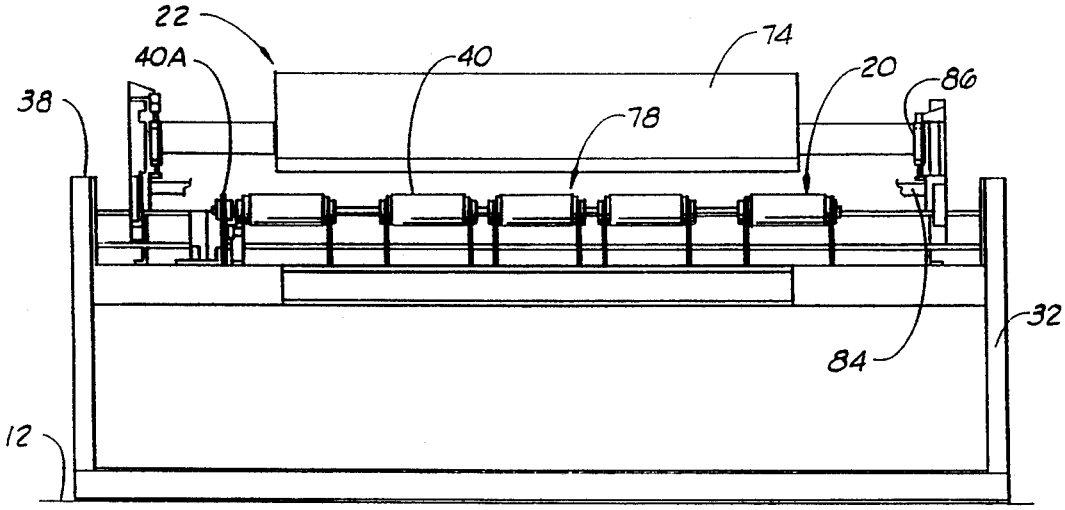
FIG. 4 is a partially detailed, end elevational view of the block conveyor of the prefeeder assembly of FIG. 1, without the conveyor belts.
Figure 7:
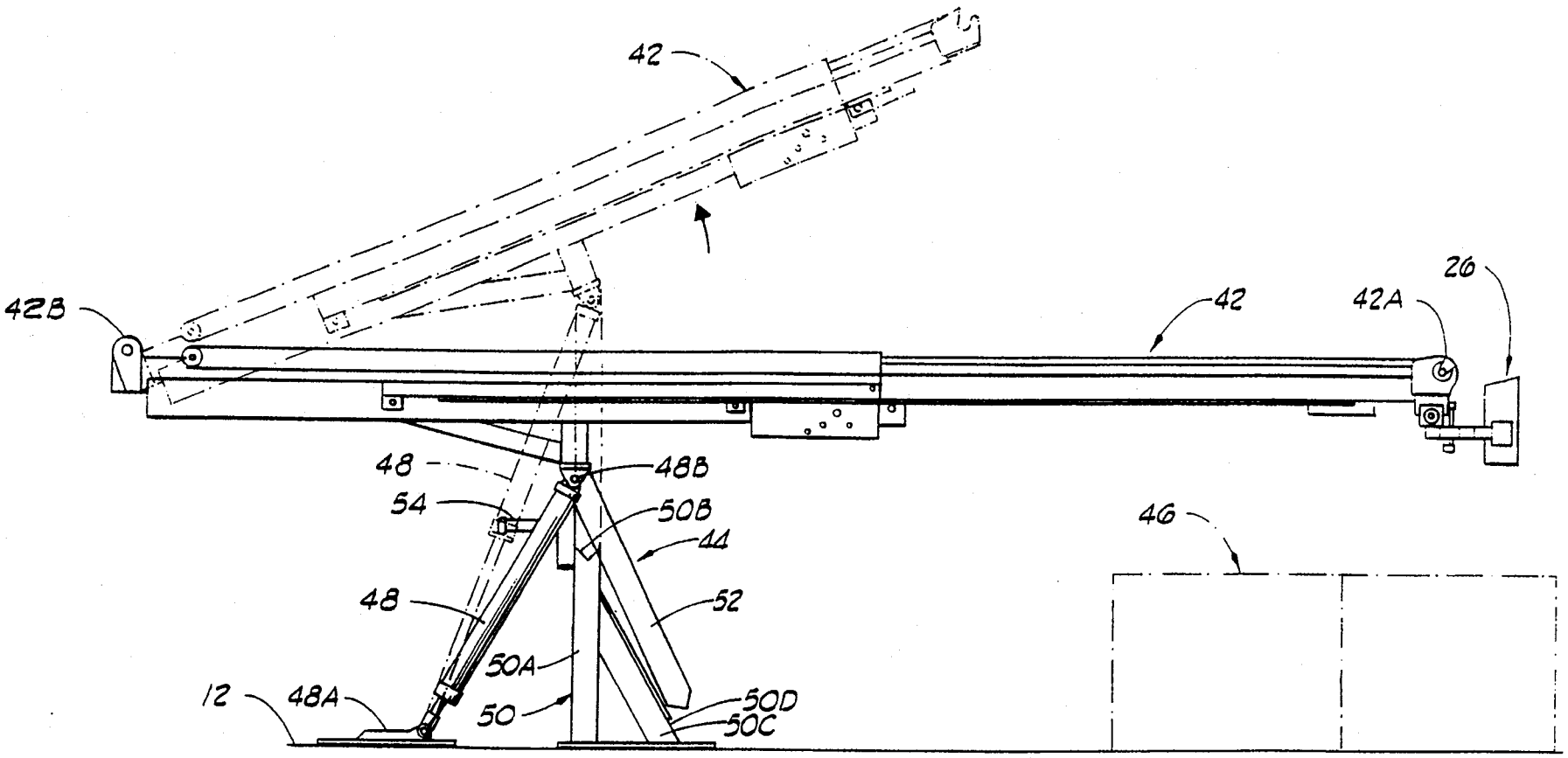
FIG. 7 is a side elevational, partial detailed view of the extendible shingle conveyor portion of the conveyor assembly of the prefeeder assembly of FIG. 1.
Figure 5:
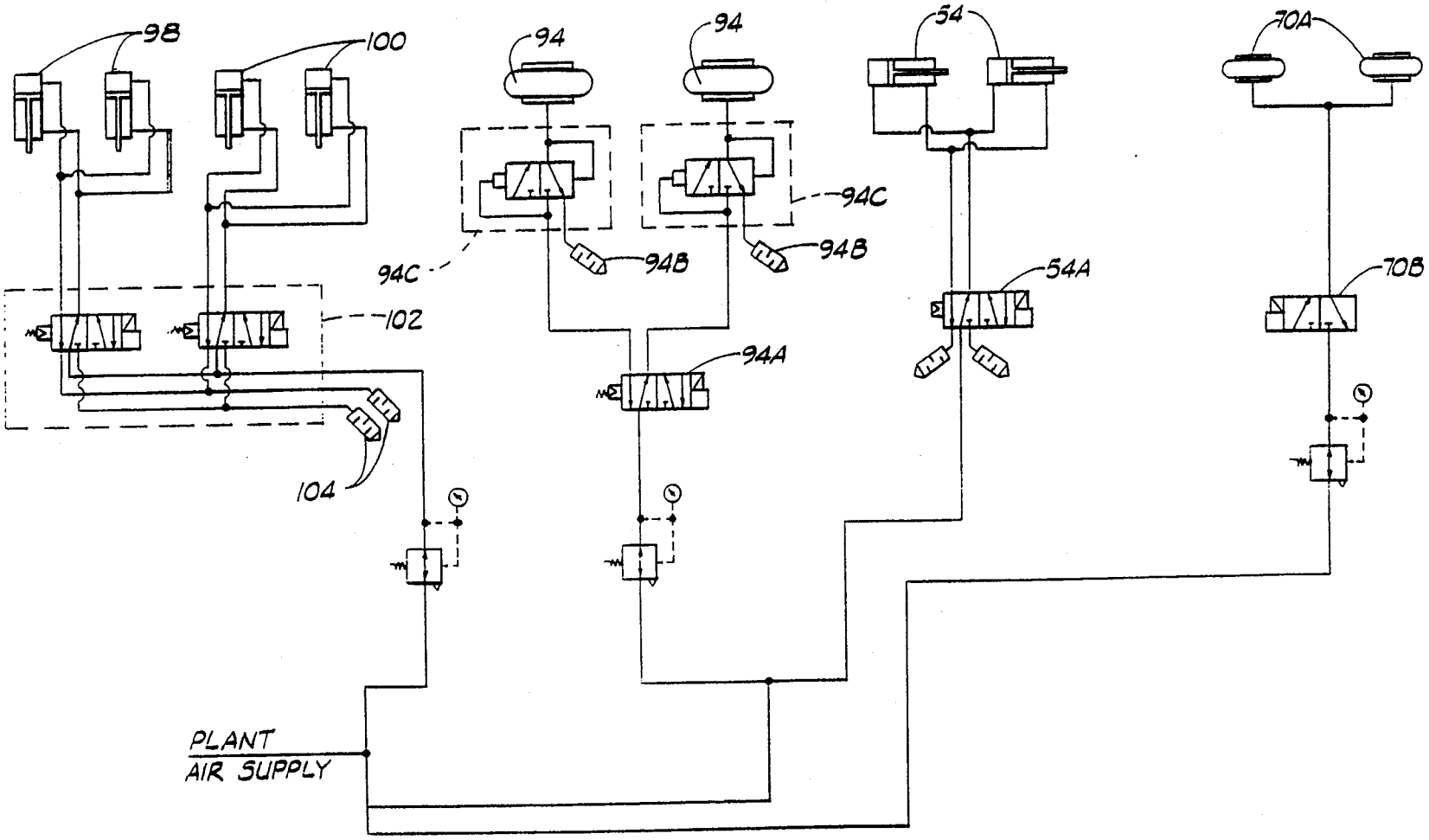

20 is a conveyor assembly, portions of which are also shown in FIGS. 3, 4 and 7.

22 is a shingling assembly. The shingling assembly 22 also appears in FIGS. 3, 4 and 6.

24 is a bottom sheet removal assembly. The bottom sheet removal assembly 24 is also shown, in whole or part, in FIGS. 4 and 6.

26 is a tamper assembly. Details of the tamper assembly are discussed more specifically hereinbelow with reference to FIGS. 8 and 9.

28 is an invertor assembly. The invertor assembly 28 is part of another embodiment of the prefeeder assembly which will be described hereinbelow with reference to FIGS. 10 and 11.

The sheet stack 14, in a typical paperboard products plant, can be as high as seven feet or more, and the construction of machinery to accommodate such height has in the past required elevated handling equipment. In the prefeeder assembly 10, the provision of the pit 12A is unique. The infeed lift conveyor assembly 16 uses the pit 12A to regulate the disposition of the top portion of the sheet stack 14 while a predetermined quantity (a block of sheets herein referred to as a block segment for convenience) is removed therefrom by the operation of the block pusher assembly 18. One such block segment 14A is shown in FIG. 1 as having been removed from the sheet stack 14 and is shown in position on the first portion of the conveyor assembly 20. Prior to removal of the block segment 14A, and prior to being lowered into the pit 12A, the height of the sheet stack 14 could potentially be much higher, such as that indicated by the broken lines 14B.

The infeed lift conveyor assembly 16 comprises the following:

30 is an infeed lift conveyor. 30A depicts a floor conveyor or the like which, as part of the material handling system of the paperboard products plant, serves to deliver sheet stacks like the sheet stack 14 to the infeed lift conveyor 30.

32 is an elevator frame which supports the infeed lift conveyor 30.

34 is a lift mechanism, including pulleyed chains and sprockets, conventional in nature, which serves to alternately elevate and lower the infeed lift conveyor 30 relative to the pit 12A to selectively position the top of sheet stack 14. The infeed lift conveyor 30 receives the sheet stack 14 from the conventional floor conveyor 30A from upstream processes in the paperboard products plant.

36 is a backstop plate for the infeed lift conveyor 30, as shown more clearly in FIG. 2. The infeed lift conveyor 30 is preferably a conventional roller type conveyor which can be powered to move the sheet stack 14 fully in the travel path to abut the vertically extending backstop plate 36.

Incidentally, FIG. 2 depicts the infeed lift conveyor 30 in an elevated position, substantially at floor level, in its stack receiving position relative to the floor conveyor 30A to conveniently receive the next sheet stack 14. Also, the infeed lift conveyor 30 is shown in a partially lowered position in FIG. 2 (without its sheet stack load) for illustrative purposes.

As shown in FIGS. 1, 3 and 4, the conveyor assembly 20 is comprised of two conveyor sections, as follows:

38 is a conveyor frame.

40 is a block conveyor supported by the conveyor frame 38.

42 is an extendible shingle conveyor having a distal end 42A and a pivotally supported end 42B.

The shingle conveyor 42 is shown in FIG. 7 in its extended, horizontal position, and also (in broken lines), in its retracted position and elevated.

44 is a conveyor support and pivoting assembly which serves to support the shingle conveyor 42 in a substantially horizontal position as shown, or to pivot same to an elevated position as depicted in broken lines.

46 is a sheet feed hopper, or the like, which is the part of the paperboard products plant to which shingled sheets are to be delivered by the prefeeder assembly 10.

The block conveyor 40 preferably has a plurality of spaced apart, endless belts supported by rollers, one set of which is powered by a power source, such as a motor and pulley mechanism 40A which is of conventional structure. It is desirable that the motor and pulley mechanism 40A have multiple speeds so that the linear travel speed of the belts of the block conveyor 40 can be set to match the horizontal travel speed of the block pusher assembly 18, discussed hereinbelow in more detail.

The shingle conveyor 42 is of conventional construction and need not be described in detail beyond the following. The shingle conveyor 42 has a plurality of spaced apart belts which are supported by several pulley sets with a loop back arrangement which permits the frame of the shingle conveyor 42 to be extended several feet horizontally while maintaining appropriate belt tightness. The extension of the shingle conveyor 42 permits the shingle sheets carried by this conveyor to fall into the sheet feeder hopper 46 depicted in broken lines in FIG. 7. The sheet feeder hopper 46 in actuality is a part of the downstream processing equipment of the paperboard products plant which is serviced by the prefeeder assembly 10.

The pivotally supported end 42B of the shingle conveyor 42 is pivotally attached to the conveyor frame 38, and near its midpoint, the shingle conveyor 42 is supported by the conveyor support and pivoting assembly 44. The conveyor support and pivoting assembly 44, a unique elevation and support device, serves to pivot the shingle conveyor 42 to an elevated position to permit access beneath this conveyor while providing complete safety to an operating personnel that must go thereunder.

The conveyor support and pivoting assembly 44 comprises the following:

48 is a pair of fluid cylinders, one on each side of the shingle conveyor 42. Each fluid cylinder 48 is pivotally attached to the support floor 12 via a plate support 48A, and is also pivotally attached to the underside of the shingle conveyor 42 at pivot point 48B. The fluid cylinders 48 are fluid actuated devices that are operated by high pressure fluid, (such as from a hydraulic pump and an appropriate valving mechanism, not shown) to have a retracted position and an extended position. In the latter mentioned extended position, the shingle conveyor 42 is caused to be pivoted to the elevated position depicted in broken lines in FIG. 7.

50 is a pair of support structures disposed on opposite sides of the shingle conveyor 42, each disposed in juxtaposition to its respective fluid cylinder 48 and supported by the support floor 12. Each support structure 50 has a vertically extending first member 50A having a top end portion 50B in the form of a v-shaped cradle. Each support structure 50 also has a second member 50C attached to its respective first member 50A; each second member 50C has a surface 50D which serves as an inclined guide surface preferably formed by an attached low friction plate made of an appropriate polymeric material such as nylon or the like.

52 is a pair of free hanging members, one on each side of the shingle conveyor 42. Each free hanging member 52 is pivotally attached at its upper end to the underside of the shingle conveyor 42 at an appropriate point such that, when the shingle conveyor 42 is elevated by the fluid cylinders 48, the lower end of the free hanging members 52 will hang directly over their respective vertically extending first members 50A. The lower end of each free hanging member 52 is preferably v-shaped to mate with the v-shaped cradle formed at the top end portion 50B of the vertically extending first member 50A.

54 is a pair of small fluid cylinders which are supported by the vertically extending first members 50A near and above the top end portions thereof, the fluid cylinders 54 being actuated by a fluid directing valve 54A. Each of the fluid cylinders 54 (schematically depicted in FIG. 9) has a ram portion extendible by fluid pressure (for example, by air pressure for air cylinders), and each fluid cylinder 54 is disposed such that its extendible ram can engage and push its respective free hanging member 52 away from alignment with the cradle top end portion 50B of the vertically extending first member 50A when the shingle conveyor 42 is sufficiently elevated to remove the weight thereof from the free hanging members 52.

In operation, to place the shingle conveyor 42 in its elevated position, the fluid cylinders 48 are extended, thereby effecting the upward pivotation of the shingle conveyor 42 about its pivotally supported end 42B. As this occurs, the free hanging members 52 are pulled upwardly until, at an appropriate height of the shingle conveyor 42, the free hanging members 52 hang freely above, and in axial alignment with, the vertically extending first member 50A. At this point, the fluid cylinders 48 are retracted so that the lower ends of the free hanging members 52 come to rest in the top end portions 50B of the first members 50A. This causes the shingle conveyor 42 to be supported stably by the extensions of the vertical extending first members 50A and the free hanging members 52; safe access is now available to the underside of the shingle conveyor 42 for personnel.

To lower the shingle conveyor 42, the process is reversed: the fluid cylinders 48 are extended just sufficiently to lift the shingle conveyor 42 and permit the free hanging members 52 to again become free hanging; at this point, the fluid cylinders 54 are extended to push their rams against the free hanging members 52, thereby causing the free hanging members 52 to pivot out of alignment with the top end portions 50B of the vertically extending first members 50A; the fluid cylinders 48 are next retracted to lower the shingle conveyor 42. Once the lower ends of the free hanging members 52 pass the top end portions 50B, the fluid cylinders 48 can be retracted fully, with the bottom ends of the free hanging members 52 sliding down the inclined guide surface 50D as the fluid cylinders 48 are completely retracted to lower the shingle conveyor 42 to its horizontal position.

It will be appreciated that the block conveyor 40 and the shingle conveyor 42 cooperate to receive the block segment 14A from the sheet stack 14 and to move same along a horizontal path. Attention will now be directed to return to FIG. 1 for discussion of the block pusher assembly 18, which serves to push the sheets from the sheet stack 14 in increments to form the block segments 14A in cooperation with the selective elevation of the infeed lift conveyor 30. With reference to FIGS. 5–5C, as well as to FIG. 1, the description of the block pusher assembly 18 will now be undertaken.

The block pusher assembly 18 is comprised of the following:

56A and 56B depict two parallel, spaced apart support arms that are pivotally connected to the elevator frame 32 via trunnions at one each of the ends thereof, and these are braced by a cross beam 56C which spans the distal ends.

58 is a travel assembly that is supported for longitudinal travel along the support arms 56A, 56B.

The travel assembly 58 is comprised of the following:

60 is a pair of rack gear runways welded to, and extending a substantial distance along the top surfaces of the support arms 56A, 56B.

62 is a traveling crossbar which extends between the support arms 56A and 56B, being rollingly supported thereon by bearing sets 62A disposed to engage the top and bottom surfaces of the support arms 56A, 56B.

64 is a drive shaft supported by bearing supports 64A along the top surface of the traveling crossbar 62.

66 is a pair of pinion gears mounted at either end of the drive shaft 64 and disposed to engage the rack gear runways 60.

68 is a motor and pulley set connected to the drive shaft 64 and mounted for travel with the traveling crossbar 62.

Figure 5:
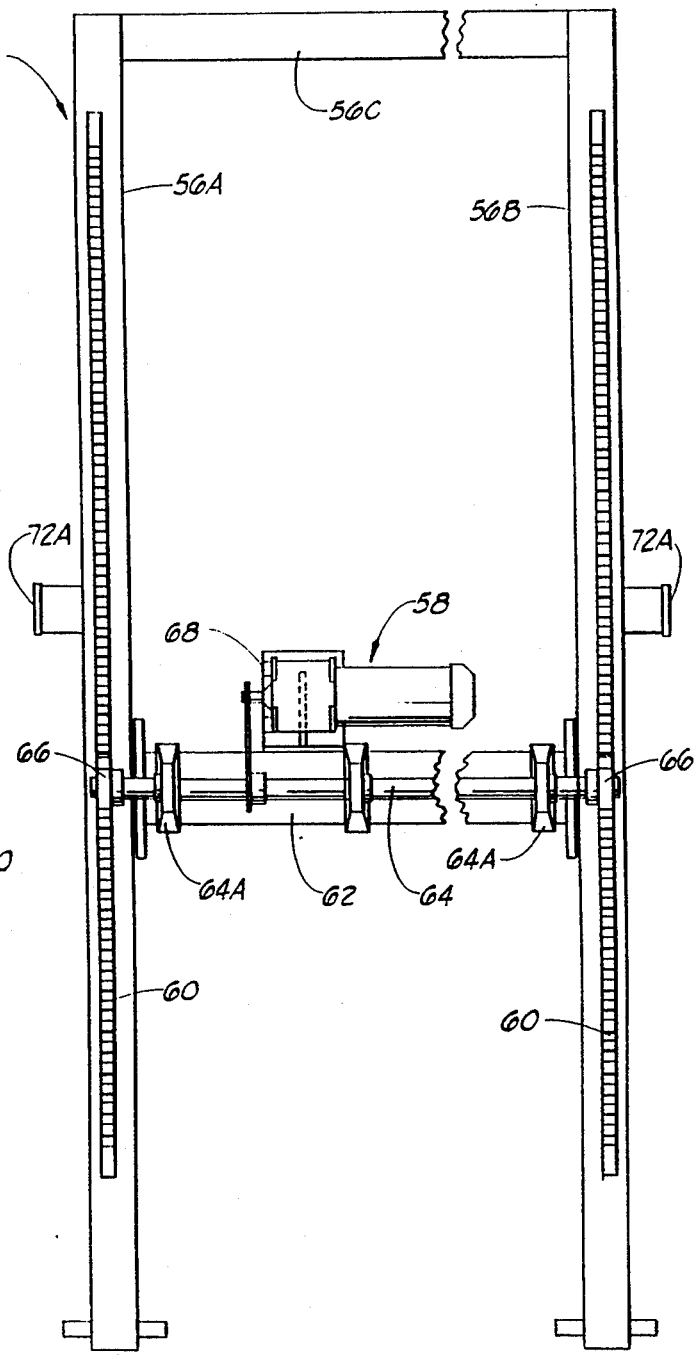
FIG. 5 is a top plan view, in partial detail of the block pusher assembly.
Figure 5B:
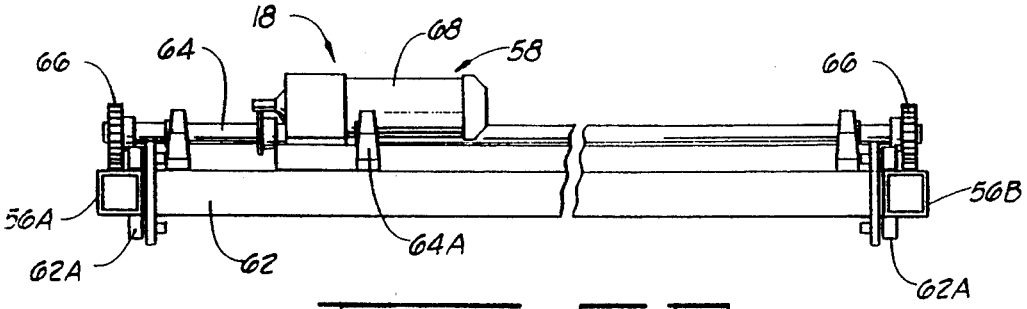
Figure 5C:
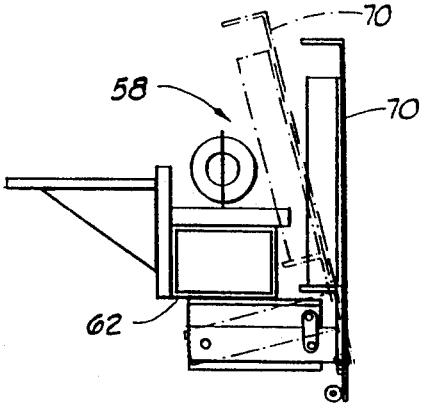
FIG. 5C is a side elevational, semi-diagrammatical depiction of the pusher plate of the block pusher assembly.
Figure 5:
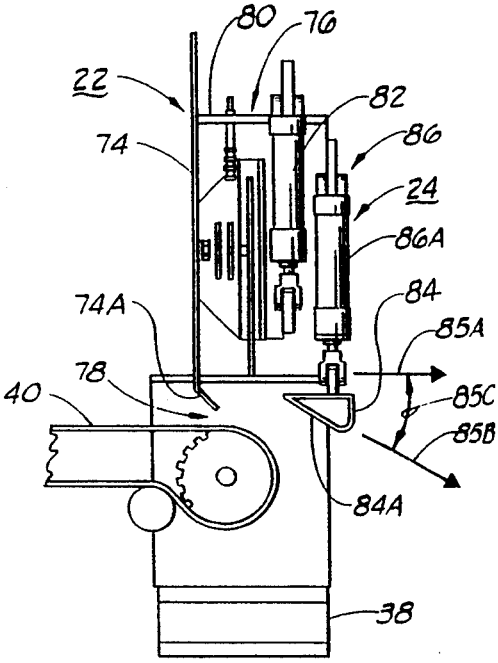
Figure 5:
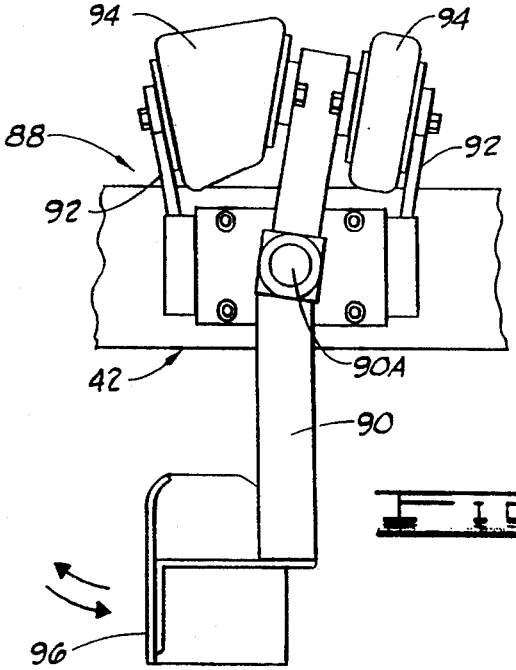

70 is pusher plate supported by the traveling crossbar 62 (removed in FIG. 5 for a clear view of other components). The pusher plate 70 is pivotally mounted for limited motion by a pair of spaced apart balloon cylinders 70A (depicted in FIG. 9 schematically and carried by the backside of the pusher plate 70, but not shown in FIGS. 5–5C). Alternate inflation and deflation of the balloon cylinders 70A, effected by a pressure directing valve 70B, cause the pusher plate 70 to move between a stack clearing mode and a stack engaging mode, the two positions depicted in FIGS. 5A and 5C. The pusher plate 70 is caused to assume its stack clearing mode for the return clearance purpose discussed hereinbelow.

The block pusher assembly 18 is also comprised of the following components:

72 is a pair of fluid cylinders (one shown in FIG. 1) that are attached between the-elevator frame 32 and a medial point 72A of the support arms 56A, 56B (best shown in FIGS. 5 and 5A). Of conventional construction, the fluid cylinders 72 are actuated by a high pressure fluid source (not shown) which causes the fluid cylinders 72 to extend for the purpose of pivoting the support arms 56A, 56B upwardly to an extended mode, and the fluid cylinders 72 are retracted for pivoting the support arms 56A, 56B downwardly to a retracted mode. In the extended mode, and with the travel assembly 58 positioned as shown in FIG. 1, the block pusher assembly 18 is caused to be elevated for horizontal movement of the sheet stack 14 beneath the pusher plate 70 for placement of the sheet stack 14 onto the infeed lift conveyor 30. As depicted by the broken lines 14B, the initial height of the sheet stack 14 is such that it just clears the overhead position of the travel assembly 58. Once the sheet stack 14 is lowered into the pit 12A by the lowering of the infeed lift conveyor 30, the support arms 56A and 56B, spaced apart to straddle the sheet stack 14, are lowered downwardly to the retraced mode where they are substantially horizontally extending.

In the retracted or lowered mode of the block pusher assembly 18, the pusher plate 70 is in position to push the block segment 14A from the top of the sheet stack 14. That is, by actuation of the motor and pulley set 68, the drive shaft 64 is caused to rotate the pinion gears 66 in engagement with the rack gear runways 60 to effect the movement of the traveling crossbar 62 and thus the pushier plate 70 in a horizontal direction, and as the travel assembly 58 is caused to come into moving engagement with the top sheets of the sheet stack 14, a quantity of sheets in height equal to the height of the pusher plate 70 will be pushed as a block segment 14A onto the block conveyor 40, as depicted in FIG. 1. Once the block segment 14A has been pushed onto the block conveyor 40, the motor and pulley set 68 is reversed to drive the traveling crossbar 62 in a roller direction back past the top of the sheet stack 14. It is during this reverse movement of the traveling crossbar 62 that the pusher plate 70 is caused to rock in a counter clockwise direction (as viewed in FIG. 1) by the inflation of the balloon cylinders 70A. This tilts the pusher plate 70 to clear the top surface of the block conveyor 40, avoiding any carryback and avoiding unnecessary drag and consequent wear.

Once the traveling crossbar 62 has been returned, the infeed lift conveyor 30 is signaled by a conventional sensing means to elevate the remaining portion of the sheet stack 14 a designated distance upwardly to expose the top portion of the sheet stack 14 for movement of another block segment 14A therefrom by repeating the horizontal movement of the travel assembly 58 with its pusher plate 70 as just described. This is repeated until the bottommost block segment 14A has been removed from the infeed lift conveyor 30 which has been raised in increments of travel to achieve selective registration of the top most portion of the sheet stack 14 relative to the block conveyor 40 and the block pusher assembly 18. Conventional sensing devices are used to sense and signal that the bottommost block segment, and thus the bottom sheet of the sheet stack 14, has been moved onto the block conveyor 40, for a purpose discussed hereinbelow.

Once the block segment 14A is on the block conveyor 40 it is in position to be shingled. As mentioned hereinabove, shingling is the term which designates the partial separation and spreading out of the sheets in overlapping fashion. This is achieved by the shingling assembly 22 which is disposed downstream and contiguous to the block conveyor 40.

The shingling assembly 22, as best shown in FIGS. 4 and 6, is comprised of the following:

74 is a shingling plate member which extends laterally to the travel direction of the block conveyor 40 and has an angularly extending lower edge 74A.

76 is a shingling control assembly which supports the shingling plate member 74 above the block conveyor 40 so that a shingling channel 78 is formed between the lower edge 74A of the shingling plate member 74 and the top surfaces of the belts of the block conveyor 40.

The shingling control assembly 76 is comprised of the following:

80 is a plate support frame laterally supported at its ends by the conveyor frame 38 for up and down sliding movement by conventional bearing surfaces (not shown).

82 is a pair of fluid cylinders, each having one end attached to the plate support frame 80 and the other end attached to the conveyor frame 38. The fluid cylinders 82 are selectively extended or retracted by a source of high pressure fluid (such as a hydraulic pump, not shown) to lower or raise the plate support frame 80, and thus to lower or raise the shingling plate member 74 so as to establish the clearance dimension of the shingling channel 78 as required. A single fluid cylinder 82 may be used, if desired, by the conventional stress transferring technique of cross reaching chain and pulley sets which assure uniform stress distribution when raising or lowering force is applied to one end only of the plate support frame 80.

Shingling occurs as the sheets of the block segment 14A are pressed against the shingling plate member 74 by the frictional contact of the powered block conveyor 40. The restriction created by the shingling channel 78 permits only a predetermined number of sheets to pass at a time, and in practice, the lower edge 74A of the shingling plate member 74 guides the leading edges of-the sheets to separate as the sheets feed from above downwardly; that is, as lower sheets of the block segment 14A are caused to pass through the shingling channel 78, the sheets above the shingling channel 78 continue to be lowered. Upon contact with the angularly disposed lower edge 74A, the force exerted by the friction of the belts of the block conveyor 40 causes the leading edges to be flared forwardly, and as the sheets pass through the shingling channels 78, the drag exerted on the sheets by the lower edge 74A, with appropriate adjustment of the clearance dimension of the shingling channel 78 for the characteristics of the sheets being shingled, causes substantially uniform partial separation and overlapping of the sheets onto the shingle conveyor 42. Thus the shingle conveyor 42 is fed a continuous stream of shingled sheets for the time required for all of the sheets of the block segment 14A to feed through the shingling channel 78. Once the last sheet of the block segment 14A has passed through the shingling channel 78, conventional sensing means disposed between the belts of the block conveyor 40 sense the absence of a sheet thereabove and signal the block pusher assembly 18 to push another block segment 14A onto the block conveyor 40 which moves it into shingling position with the shingling assembly 22.

A unique feature of the present invention is the capability of removing one or more of the sheets being shingled by the shingling assembly 22. This will usually be the bottom sheet of the block segment 14A, and usually only the bottommost sheet of the last block segment 14A removed from the sheet stack 14 as this sheet will be the bottom sheet of the sheet stack 14. The reason that it is often desirable to remove the bottom sheet of the sheet stack 14 is that his sheet often receives abuse to the point of being marred during travel of the sheet stack 14 on conveyors in a paperboard products plant. Removal of this bottom sheet is often desirable to keep it from passing to final processing, such as printing and forming steps, thus reducing unwanted scrapping during final operation.

Conventional sensors (such as photoelectric sensors, not shown) sense when the infeed lift conveyor 30 has been raised to its maximum level, thus signaling that the bottommost block segment 14A is being moved into the block conveyor 40 by the block pusher assembly 18. The bottom sheet is removed by the bottom sheet removal assembly 24, which is comprised to the following (with continued reference to FIG. 6):

84 is a diverter bar having a front diverter plate portion 84A which is angularly disposed. The horizontal travel of shingle sheets passed through the shingling channel 78 of the shingling assembly 22 is indicated by the arrow 85A, a horizontal vector, while a travel route indicated by arrow 85B indicates a path wherein the shingled sheets are diverted by the diverter bar 84 away from the normal horizontal path to below the shingle conveyor 42. The angle of the diverter plate 84A relative to the horizontal travel vector is the angle 85C indicated between the arrow 85A and the arrow 85B, and this angle 85C, is just that amount of angular displacement adequate to effectuate sheet diversion and removal. Generally, good results have been achieved when the angle 85C of the diverter plate 84A is about 30 degrees off horizontal.

86 is a diverter actuator mechanism which comprises a cross frame member (as depicted in FIG. 4) which is slidably supported by bearing surfaces on the conveyor frame 38 for up and down movement. A pair of fluid cylinders 86A support the diverter bar 84 is a first position or in a second position by actuation of the fluid cylinders 86A by a source of pressurized fluid (such as a hydraulic pump and appropriate valving, not shown). In the first position, the fluid cylinders 86A are retracted so as to raise the diverter bar 84 to a position such that the diverter plate 84A is in the path of shingled sheets exiting the shingling assembly 22 so that the sheets striking the diverter plate 84A are diverted away from the shingle conveyor 42. When the diverter bar 84 is lowered by extension of the fluid cylinders 86A, that is when the diverter bar 84 is moved to its second position, the diverter plate 84A will be in clearing relationship to the shingled sheets which will pass over the diverter bar 84 and onto the shingle conveyor 42.

In operation, the selective positioning of the diverter bar 84 to divert the bottommost sheet of the last block segment 14A that is passed from the infeed lift conveyor 30 to the block conveyor 40 is sensed by the conventional sensors above mentioned, and the diverter bar 84 is appropriately raised to divert the first or bottommost sheet passing through the shingling channel 78, and once this bottommost sheet has been diverted, the diverter bar 84 is immediately lowered so that the remaining sheets can be shingled onto the shingle conveyor 42. Depending upon the characteristics of the paperboard products being processed, it may be desirable to lower the shingling plate 74 momentarily to reduce the clearance dimension of the shingling channel 78 to permit passage of a single sheet with the diverter bar 84 raised to its sheet diverting position; and once the leading edge of the single sheet is diverted by the diverter bar 84, the shingling plate 74 can then again be adjusted upwardly to permit multiple sheet passage. Generally speaking, this is a matter of adjusting the cycling of these components to accommodate the characteristics of the paperboard products being shingled.

Turning now to the tamper assembly 26, it will be noted that this is illustrated in part in FIG. 8 and schematically in FIG. 9. The tamper assembly 26 is supported at the distal end 42 of the shingle conveyor 42 and serves to tamp the edges of the shingle sheets as they are discharged and accumulated in the sheet feeder hopper 46. The tamper assembly 26 is comprised of several side edge tampers and end edge tampers. A side edge tamper mechanism 88 is shown in plan view in FIG. 8 and comprises the following:

90 is a tamper support arm which is mounted for pivotation by the bearing connection 90A to the underside of the shingle conveyor 42. The tamper support arm 90 has a bend in it which effects a quicker return, but is optional, depending on the characteristics of the tamping impact that is desired.

92 is a pair of balloon support arms supported by the shingle conveyor 42 on either side of the tamper support arm 90.

94 is a pair of balloon cylinders, each balloon cylinder 94 connected between one of the balloon support arms and the tamper support arm 90, as shown.

96 is a tamping plate connected to the extending tamper support arm 90.

The balloon cylinders 94 are conventional structures of the type that have an elastomeric or polymeric bellows that inflates with air pressure. The schematic of FIG. 9, which need not be described in close detail as such schematics are commonly understood by persons skilled in the art, shows that the balloon cylinders 94 are inflatable by plant air pressure selectively by an electrically controlled air directing valve 94A. Air pressure is alternately cycled to one of the balloon cylinders 94 and then to the other balloon cylinder 94, each of which alternately inflate and then deflate, exhausting air through a pair of muffler exhausts 94B. This cycling is effected by the combined action of the air directing valve 94A and the cycling valving 94C.

As the balloon cylinders alternately inflate and deflate in cyclic sequence, the tamper support arm 90 is rapidly moved in alternating directions of rotation, thereby imparting a tamping motion to the tamping plate 96.

As noted, two of the tamper mechanisms 88 are disposed to extend from the distal end 42A of the shingle conveyor 42 on either side of the discharging sheets to tamp the side edges thereof. A pair of more of end edge tampers preferably are disposed between the tamper mechanisms 88 to tamp against the end edges of the discharging sheets nearest to the shingle conveyor 42. While such tamper mechanisms may be similar in structure to that described for the tamper mechanism 88, such mechanisms can also be powered by conventional pneumatic cylinders as depicted in FIG. 9, wherein the following components are depicted:

98 is a first pair of pneumatic tampers.

100 is a second pair of pneumatic tampers.

102 is a valving arrangement to cycle air pressure to the first and second pairs of pneumatic tampers 98, 100. The first pair of pneumatic tampers 98 act in unison, as do the second pair of pneumatic tampers 100. The first pneumatic tampers 98 are alternately extended and retracted by air pressure alternately cycled and discharged therefrom, as are the second pneumatic tampers 100, with the air is exhausted therefrom passing through the air exhausts 104. The pneumatic tampers 98, 100 are spaced along and extend from beneath the distal end 42A of the shingle conveyor 42, and are timed to tamp against the end edges of the discharging sheets.

Figure 10:
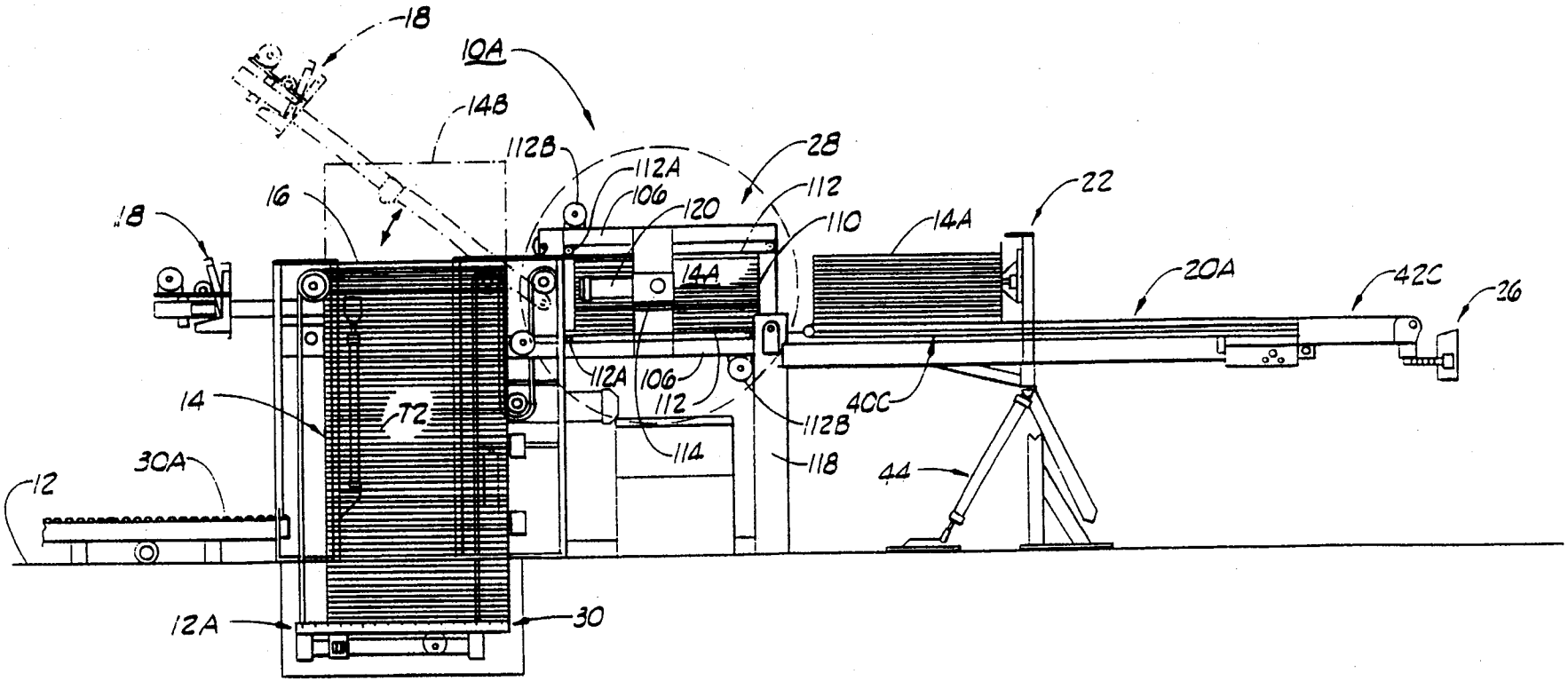
FIG. 10 is a side elevational view of another embodiment of a prefeeder assembly constructed in accordance with the present invention.
Figure 11:
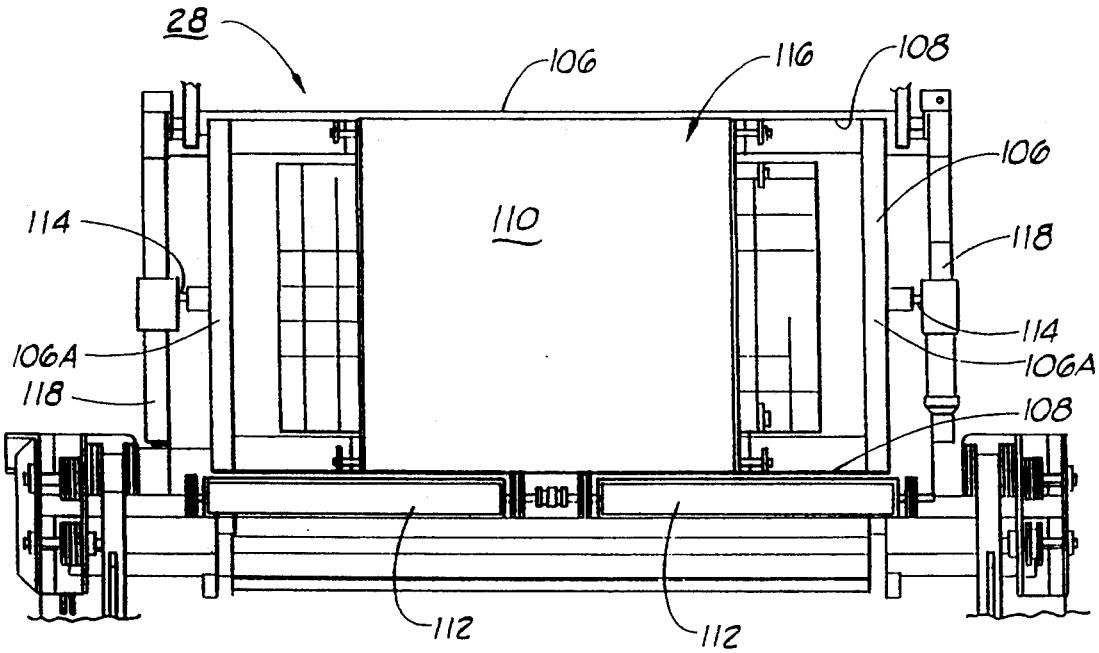
FIG. 11 is a top plan view of the block inverter assembly of the prefeeder assembly of FIG. 10, with the view in FIG. 11 having many details omitted to disclose those shown.

FIGS. 10 and 11

The prefeeder assembly 10 as described will accommodate the shingling needs of most paperboard products except in cases, for example, where printed paperboard sheets need to be inverted and shingled for passing to a final printing operation. In such cases, there generally is not a need to mechanically remove the bottom sheet as this sheet winds up on top of the block stack once the block stack is inverted, providing for easy hand removal of the formerly bottom sheet, or else marring is not a problem due to limited conveyor travel of such sheets. It is toward this need that the prefeeder assembly 10A as illustrated in FIGS. 10 and 11 is directed. As before, like numerals will be used to designate components and elements of the prefeeder assembly 10A which are common to that found in the prefeeder assembly 10, and such components and elements will not be described again.

The prefeeder assembly 10A, in addition to having the block inverter assembly 28 and not having the bottom sheet removal assembly 24, has a shingle conveyor assembly 20A which is of similar construction to the shingle conveyor 42, so this need not be described. The shingling assembly 22 is mounted on the conveyor assembly 20A at a point such that the first portion of the conveyor 20A serves as a block conveyor 40C and the second portion serves as a shingle conveyor 42C.

The block inverter assembly 28 is positioned adjacent to and in sheet receiving relationship to the infeed lift conveyor assembly 16 so that the block segment 14A is pushed from the sheet stack 14 by the pusher plate 70 of the block pusher assembly 18 into the block inverter assembly 28. The block inverter assembly 28 is comprised of the following:

106 is a pair of parallel and spaced apart block platforms held apart by a pair of frame members 106A.

108 is a pair of supporting plate members, one each mounted on one of the block platforms 106.

110 is a block retention and pusher plate disposed between the supporting plate members 108.

112 is a pair of traveling carriers which support the block retention and pusher plate 110 on each end thereof and which are disposed to travel on rollers 112A and powered by motors 112B supported on opposing block platforms 106.

114 is a pair of pivot connectors which bearingly connect via an arbor mount to the frame members 106A.

The block platforms 106, the supporting plate members 108, the block retention and pusher plate 110 and the traveling carriers 112 form a block inverter unit 116 which is mounted for pivotation at its central point by the pair of pivot connectors 114 on a frame 118 to which the pivoting end of the conveyor 20A is also connected. A motor mechanism 120 serves to selectively rotate the block inverter unit 116.

The spaced apart supporting plate members 108 define a block receiving cavity therebetween for receiving the block segment 14A pushed from the top of the sheet stack 14 by the block pusher assembly 18 in the manner described above for the prefeeder assembly 10, except that for the latter, the block segment 14A is pushed onto the block conveyor 40. In the prefeeder assembly 10A on the other hand, the block segment 14A is pushed into the block receiving cavity against the block retention and pusher plate 110 which is disposed at the far end by the traveling carriers 112. The motor mechanism 120 then rotates the block inverter unit 116, and the block segment 14A carried within it, clockwise for a 180 degree turn so that the block segment 14A is inverted. The inversion of the block inverter unit 116 places the block retention and pusher plate 110 upstream to the block segment 14A, and the motor mechanism 120, driving the traveling carriers 112, causes the block retention and pusher plate 110 to be moved toward the conveyor assembly 20A, thereby pushing the block segment 14A onto the first portion 40C of the conveyor assembly 20A which proceeds to move the block segment 14A into shingling engagement with the shingling assembly 22.

With the block inverter unit 116 serving to receive the block segment 14A directly from the infeed lift conveyor 30, a series of entry rollers are provided for transit of the heavy block segment 14A into the block receiving cavity of the invertor assembly 28. These are entry rollers 122 shown in FIG. 11.

The supporting plate members 108 should be made of a wear resistant material, and in some applications, it may be advisable to provide each such supporting plate 108 with a plurality of surface rollers (as shown in FIG. 11) to reduce the friction of sliding block segments therealong. It should be noted that the block retention and pusher plate 110 serves to retain the block segment 14A in the block receiving cavity during pivotation of the block inverter unit 116 and pushes the block segment 14A from the block receiving cavity following pivotation. In order to reduce the wear on this element, especially when processing very large sheets for which the block segment can weigh hundreds of pounds, the rollers on the supporting plate members 108 may well become a necessity for ease in moving the block segment from the block receiving cavity.

It is clear that the present invention is well adapted to carry out the objects and obtain the ends and advantages mentioned herein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. A prefeeder assembly for shingling sheets of planar material from block segments removed from a sheet stack and passing the sheets to a sheet feeder hopper, the prefeeder assembly supported on a support floor having a pit, the prefeeder assembly comprising:

infeed lift conveyor means for receiving the sheet stack substantially at floor level and for selectively lifting the sheet stack so that block segments of the sheets can be moved therefrom, the infeed lift conveyor comprising:

a main frame;

an elevator frame supported by the support floor and having a portion disposed in near proximity to the pit;

an infeed lift conveyor; and lift means supported by the elevator frame for supporting the infeed lift conveyor and for selectively lowering the infeed lift conveyor into the pit and raising the infeed lift conveyor incrementally from the pit;

block pusher means for sequentially pushing each block segment from the sheet stack, the block pusher means pivotally supported for clearing access for horizontal stack movement therebeneath, the block pusher means comprising:

at least one support arm pivotally connected to the main frame;

a travel assembly supported by the support arm, the travel assembly comprising:

a pusher plate;

travel means for moving the pusher plate alternatively in opposing forward and reverse directions along the support arm so that movement of the pusher plate in the forward direction pushes the block segments one at a time from the stack on the infeed lift conveyor means;

a cross bar support member extending laterally to and movable along the support arm, the pusher plate supported by the cross bar support member and having limited clearing movement relative to the cross bar to move into a stack clearing move; and means for selectively moving the pusher plate to its stack clearing mode to provide stack clearance when the pusher plate is moved in the reverse direction along the support arm;

fluid cylinder means for pivoting the support arm upwardly in an extended mode and for pivoting the support arm downwardly in a retracted mode, there being access provided for horizontal stack movement beneath the pusher plate for placement of the stack onto the infeed lift conveyor means when the fluid cylinder means is in the extended mode, the pusher plate positionable in moving engagement with the uppermost block segment in the stack supported by the prefeeder lift conveyor means when the fluid cylinder means is in the retracted mode;

conveyor means for receiving block segments and for moving same to discharge the sheets into the sheet feeder hopper, the conveyor means comprising:

a conveyor frame;

a shingle conveyor having first and second ends, the first end of the shingle conveyor pivotally supported by the conveyor frame and the second end of the shingle conveyor disposed to discharge shingled sheets into the sheet feeder hopper;

power means for powering the shingle conveyor to move the shingled sheets therealong; and conveyor support and pivoting means supporting the second end of the shingle conveyor for selectively pivoting the second end to an elevated position and to a substantially horizontal position, the conveyor support and pivoting means comprising:

a fluid cylinder having an extended position and a retracted position;

a support structure supported by the floor and having a vertically extending first member with a top end portion and a second member with an inclined guide surface;

a free hanging member pivotally connected to the shingle conveyor, the free hanging member disposable along the inclined guide surface when the shingle conveyor is in the horizontal position and the free hanging member caused to be pulled up the inclined guide surface as the shingle conveyor is moved to the elevated position by the fluid cylinder so that the free hanging member is caused by gravity to hang from the shingle conveyor over and in supporting engagement with the top end of the first member of the support structure as the shingle converyor is lowered so that the second end of the shingle conveyor is supported substantially in the elevated position thereof by the free hanging member extending upward from the first member of the support structure; and fluid means for alternately positioning the fluid cylinder in the extended position and in the retracted position;

shingling means for shingling the sheets on the conveyor means prior discharge into the sheet feeder hopper, the shingling means comprising:

a shingling plate member having an angularly extending lower edge;

shingling control means for supporting the shingling plate member laterally to and above the conveyor means forming a shingling channel between the angularly extending lower edge of the shingling plate member and the conveyor means, the shingling control means selectively estabilishing the clearance dimension of the shingling channel;

tamper means for tampering the edges of the sheets after discharge from the conveyor means, the tamper means comprising:

a pair of tamper plates;

a pair of tamper plate support arms, each supporting one of the tamper plates and each supported by the conveyor means; and means for imparting tamping motion to the tamper plates.

2. The prefeeder assembly of claim 1 further comprising:

block inverter means for inverting each block segment pushed from the sheet stack by the block pusher means and for passing the inverted block segment to the conveyor means, the block inverter means comprising:

a frame;

a block receiving assembly having a laterally extending central axis and supported by the frame for pivotation generally about the central axis, the block receiving assembly comprising:

a first supporting plate member; and a second supporting plate member, the first and second supporting plate members disposed in parallel, spaced apart relationship to form a block receiving cavity therebetween;

means supported by the block receiving assembly for retaining the block segment in the block receiving cavity during pivotation of the block receiving cavity during pivotation of the block receiving assembly and for moving the block segment from the block receiving cavity following pivotation to invert the block segment; and power means for selectively pivoting the block receiving assembly to alternately dispose the first and second supporting plate members in position to receive a block segment from the block pusher means.

3. The prefeeder assembly of claim 2 further comprising:

power means for selectively powering the infeed lift conveyor.

4. The prefeeder assembly of claim 3 wherein the conveyor means further comprises:

a block conveyor having first and second ends, the first end of the block conveyor disposed to receive the block segments as the block pusher pushes the block segments from the sheet stack, the second end of the block conveyor disposed to deliver the block segments to the first end of the shingle conveyor; and block conveyor power means for selectively powering the block conveyor so that a block segment is moved along the block conveyor.

5. The prefeeder assembly of claim 1 further comprising:

bottom sheet removal means for removing the bottom sheet of the last removed block segment from the sheet stack, the bottom sheet removal means comprising:

a diverter plate; and diverter actuator means for supporting the diverter plate in a first position and a second position, the diverter plate in the first position is disposed in the path of the shingled sheets so that at least the bottommost sheet on the conveyor means is diverted to pass away from the conveyor means, and the diverter plate in the second position is disposed in clearing relationship to the shingled sheets.

6. A prefeeder assembly for shingling sheets of planar material from block segments removed from a sheet stack and passing the sheets to a sheet feeder hopper, the prefeeder assembly supported on a support floor having a pit, the prefeeder assembly comprising:

infeed lift conveyor means for receiving the sheet stack substantially at floor level and for selectively lifting the sheet stack so that block segments of the sheets can be moved therefrom, the infeed lift conveyor means comprising:

a main frame;

an elevator frame supported by the support floor and having a portion disposed in near proximity to the pit;

an infeed lift conveyor; and lift means supported by the elevator frame for supporting the infeed lift conveyor and for selectively lowering the infeed lift conveyor into the pit and raising the infeed lift conveyor incrementally from the pit;

block pusher means for sequentially pushing each block segment from the sheet stack, the block pusher means pivotally supported for clearing access for horizontal stack movement therebeneath, the block pusher means comprising:

at least one support arm pivotally connected to the main frame;

a travel assembly supported by the support arm, the travel assembly comprising:

a pusher plate;

travel means for moving the pusher plate alternatively in opposing forward and reverse directions along the support arm so that movement of the pusher plate in the forward direction pushes the block segments one at a time from the stack on the infeed lift conveyor means; and a cross bar support member extending laterally to and movable along the support arm, the pusher plate supported by the cross bar support member and having limited clearing movement relative to the cross bar to move into a stack clearing mode; and means for selectively moving the pusher plate to its stack clearing mode to provide stack clearance when the pusher plate is moved in the reverse direction along the support arm;

fluid cylinder means for pivoting the support arm upwardly in an extended mode and for pivoting the support arm downwardly in a retracted mode, there being access provided for horizontal stack movement beneath the pusher plate for placement of the stack onto the infeed lift conveyor means when the fluid cylinder means is in the extended mode, the pusher plate positionable in moving engagement with the uppermost block segment in the stack supported by the prefeeder lift conveyor means when the fluid cylinder means is in the retracted mode;

conveyor means for receiving block segments from the infeed lift conveyor and for moving same to discharge the sheets into the sheet feeder hopper, the conveyor means comprising:

a conveyor frame;

a shingle conveyor having first and second ends, the first end of the shingle conveyor pivotally supported by the conveyor frame and the second end of the shingle conveyor disposed to discharge shingled sheets into the sheet feeder hopper;

power means for powering the shingle conveyor to move the shingled sheets therealong; and conveyor support and pivoting means supporting the second end of the shingle conveyor for selectively pivoting the second end to an elevated position and to a substantially horizontal position, the conveyor support and pivoting means comprising:

a fluid cylinder having an extended position and a retracted position;

a support structure supported by the floor and having a top end portion and an inclined guide surface;

a free hanging member pivotally connected to the shingle conveyor, the free hanging member disposable along the inclined guide surface when the shingle conveyor is in the horizontal position and the free hanging member caused to be pulled up the inclined guide surface as the shingle conveyor is moved to the elevated position by the fluid cylinder so that the free hanging member is caused by gravity to extend from the shingle conveyor over and in supporting engagement with the top end of the first member of the support structure as the shingle conveyor is lowered so that the second end of the shingle conveyor is supported substantially in the elevated position thereof; and fluid means for alternately positioning the fluid cylinder in the extended position and in the retracted position;

shingling means for shingling the sheets on the conveyor means prior to discharge into the sheet feeder hopper, the shingling means comprising:

a shingling plate member having a lower edge; and shingling control means for supporting the shingling plate member above the conveyor means to form a shingling channel between the lower edge of the shingling plate member and the conveyor means, the shingling control means selectively establishing the clearance dimension of the shingling channel.

7. A prefeeder assembly for shingling sheets of planar material from block segments removed from a sheet stack and passing the sheets to a sheet feeder hopper, the prefeeder assembly supported on a support floor having a pit, the prefeeder assembly comprising:

infeed lift conveyor means for receiving the sheet stack substantially at floor level and for selectively lifting the sheet stack so that block segments of the sheets can be moved therefrom, the infeed lift conveyor means comprising:

an elevator frame supported by the support floor and having a portion disposed in near proximity to the pit;

an infeed lift conveyor having a main frame;

lift means supported by the elevator frame for supporting the infeed lift conveyor and for selectively lowering the infeed lift conveyor into the pit and raising the infeed lift conveyor incrementally from the pit;

block pusher means for sequentially pushing each block segment from the sheet stack, the block pusher means pivotally supported for clearing access for horizontal stack movement therebeneath, the block pusher means comprising:

at least one support arm pivotally connected to the main frame;

a travel assembly supported by the support arm, the travel assembly comprising:

a pusher plate;

travel means for moving the pusher plate alternatively in opposing forward and reverse directions along the support arm so that movement of the pusher plate in the forward direction pushes the block segments one at a time from the stack on the infeed lift conveyor means;

a cross bar support member extending laterally to and movable along the support arm, the pusher plate supported by the cross bar support member and having limited clearing movement relative to the cross bar to move into a stack clearing mode; and means for selectively moving the pusher plate to its stack clearing mode to provide stack clearance when the pusher plate is moved in the reverse direction along the support arm;

fluid cylinder means for pivoting the support arm upwardly in an extended mode and for pivoting the support arm downwardly in a retracted mode, there being access provided for horizontal stack movement beneath the pusher plate for placement of the stack onto the infeed lift conveyor means when the fluid cylinder means is in the extended mode, the pusher plate positionable in moving engagement with the uppermost block segment in the stack supported by the prefeeder lift conveyor means when the fluid cylinder is in the retracted mode;

conveyor means for receiving block segments and for moving same to discharge the sheets into the sheet feeder hopper, the conveyor means comprising:

a conveyor frame;

a shingle conveyor frame having first and second ends, the first end of the shingle conveyor pivotally supported by the conveyor frame and the second end of the shingle conveyor disposed to discharge shingled sheets into the sheet feeder hopper;

power means for powering the shingle conveyor to move the shingled sheets therealong; and conveyor support and pivoting means supporting the second end of the shingle conveyor for selectively pivoting the second end to an elevated position and to a substantially horizontal position;

shingling means for shingling the sheets on the conveyor means prior to discharge into the sheet feeder hopper, the shingling means comprising:

a shingling plate member having a lower edge; and shingling control means for supporting the shingling plate member above the conveyor means to form a shingling channel between the lower edge of the shingling plate member and the conveyor means, the shingling control means selectively establishing the clearance dimension of the shingling channel;

tamper means for tamping the edges of the sheets after discharge from the conveyor means;

block inverter means for inverting each block segment pushed from the sheet stack by the block pusher means and for passing the inverted block segment to the conveyor means, the block inverter means comprising:

a frame;

a block receiving assembly having a laterally extending central axis and supported by the frame for pivotation generally about the central axis, the block receiving assembly comprising:

a first supporting plate member; and a second supporting plate member, the first and second supporting plate members disposed in parallel, spaced apart relationship to form a block receiving cavity therebetween;

means supported by the block receiving assembly for retaining the block segment in the block receiving cavity during a pivotation of the block receiving cavity during a pivotation of the block receiving assembly and for moving the block segment from the block receiving cavity following pivotation to invert the block segment; and power means for selectively pivoting the block receiving assembly to alternately dispose the first and second supporting plate members in position to receive a block segment from the block pusher means.

* * * * *

UNITED STATES PATENT AND TRADEMARK OFFICE

CERTIFICATE OF CORRECTION

PATENT NO. : 5,423,657

DATED : June 13, 1995

INVENTOR(S) : Terry M. Frost, Terry B. Smith, Jon P. Drake and Hugh F. Moran

It is certified that error appears in the above-indentified patent and that said Letters Patent is hereby corrected as shown below:

Column 8, line 5, delete "pushier" and substitute therefor --pusher--;

Column 9, line 16, after "of" delete "-";

Column 9, line 49, delete "his" and substitute therefor --this--; and

Column 10, line 7, after "85C" delete ",".

Signed and Sealed this

Twelfth Day of December, 1995

*Attest:*

*Attesting Officer*

Bruce Lehman

BRUCE LEHMAN

*Commissioner of Patents and Trademarks*